US006753893B1

(12) United States Patent
Kitazawa

(10) Patent No.: US 6,753,893 B1
(45) Date of Patent: Jun. 22, 2004

(54) THERMAL HEAD AND METHOD FOR MANUFACTURING THE SAME

(75) Inventor: Yusuke Kitazawa, Asahikawa (JP)

(73) Assignees: Kabushiki Kaisha Toshiba, Tokyo (JP); Toshiba Hokuto Electronics Corp., Asahikawa (JP)

( * ) Notice: Subject to any disclaimer, the term of this patent is extended or adjusted under 35 U.S.C. 154(b) by 0 days.

(21) Appl. No.: 10/088,087

(22) PCT Filed: Sep. 22, 2000

(86) PCT No.: PCT/JP00/06525

§ 371 (c)(1),
(2), (4) Date: Mar. 21, 2002

(87) PCT Pub. No.: WO01/21409

PCT Pub. Date: Mar. 29, 2001

(30) Foreign Application Priority Data

Sep. 22, 1999 (JP) ..... 11-269282

(51) Int. Cl.[7] ..... B41J 2/335
(52) U.S. Cl. ..... 347/206
(58) Field of Search ..... 347/206, 202, 347/203, 220, 200, 204, 205, 208–209, 62

(56) References Cited

U.S. PATENT DOCUMENTS

| | | | | |
|---|---|---|---|---|
| 4,707,708 A | | 11/1987 | Kitagishi et al. | 347/202 |
| 4,777,583 A | * | 10/1988 | Minami et al. | 347/208 |
| 6,151,054 A | * | 11/2000 | Shimizu | 347/204 |
| 6,184,913 B1 | * | 2/2001 | Nagano et al. | 347/203 |
| 6,529,224 B2 | * | 3/2003 | Shirakawa et al. | 347/200 |

FOREIGN PATENT DOCUMENTS

| | | |
|---|---|---|
| JP | 3-7354 | 1/1991 |
| JP | 8-207334 | 8/1996 |

OTHER PUBLICATIONS

Yoshida Atsushi, Thermal Head and its Manufacture, Patent Abstracts of Japan, JP 11–034373, Feb. 9,1999.
Sato Masamichi, Thermal Head and its Manufacture, Patent Abstracts of Japan, JP 08–207334, Aug. 13, 1996.
Kazuo et al., Thermal Head and Manufacture thereof, Patent Abstracts of Japan, JP 03–007354, Jan. 14, 1991.

* cited by examiner

*Primary Examiner*—K. Feggins
(74) *Attorney, Agent, or Firm*—Oblon, Spivak, McClelland, Maier & Neustadt, P.C.

(57) ABSTRACT

A thermal head has a longitudinal substrate; a heat-retention layer made of a heat-retaining material, having at least a sticking-out section lying on one main surface of the substrate in a longitudinal direction at a constant width; a heating-resistor member made of a resistive material, formed at least on the sticking-out section of the heat-retention layer at a predetermined thickness; a common electrode provided as touching the heating-resistor member; a plurality of separated electrodes provided as facing a tip of the common electrode with a gap, at least an edge of each separated electrode touching the heating-resistor member, another edge of each separated electrode being connected to a driver circuit; and a protective layer formed on the heating-resistor member. A heating-resistor member portion provided on to the gap between the common electrode and the separated electrodes functions as a recording section. The sticking-out section is formed in straight in the longitudinal direction of the substrate and has a almost flat summit surface. The recording section is formed on the flat summit surface.

10 Claims, 10 Drawing Sheets

ENLARGED CROSS SECTIONAL VIEW TAKEN ON ARROWS X-X

THERMAL HEAD AND METHOD FOR MANUFACTURING THE SAME

TECHNICAL FIELD

The present invention relates to a method of producing a thermal head. Particularly, this invention relates to the structure of a thermal head and a method of producing the thermal head, which offer high recording quality with improvement in the structure of a recording section for recording on a recording medium inserted between a platen and the recording section, for prevention of shifting of the recording section from a correct position to be recorded.

BACKGROUND ART

Thermal heads have an important place in the fields of OA (Office Automation)-devices and fax machines. A thermal head is made up of heating resistors arranged on a substrate. The heating resistors generate heat for recording on heat-sensitive papers or films of type-setting developing paper. Several developments have been in progress for their low noise level and low running cost. Thermal heads have recently attracted attention as being used for video printers, for example.

FIG. 1 is a plan view of an overall structure of a conventional thermal head, partially cut away in several stages for easy understanding. FIG. 2 is an enlarged cross sectional view taken on arrows X—X of the thermal head shown in FIG. 1. In these drawings, the thermal head is provided with an aluminum substrate 1 formed with long narrow flat surface and having thickness for certain rigidity, a ceramic substrate 2 formed on a main surface of the aluminum substrate 1 and having a thickness of 0.5 to 1.0 mm, thermal resistance and relatively large coefficient of heat transfer, and several integrated circuits 8 (abbreviated to IC hereinafter) aligned in row at the side of the ceramic substrate 2. Formed on the center portion of the ceramic substrate 2 in the width direction in this structure is a glaze layer 3 as a heat-retention layer having a semi-gabled transversal surface formed in the longitudinal direction. A heating-resistor layer 4 is formed on the surface of the ceramic substrate 2 including the glaze layer 3.

The glaze layer 3 is mainly made of glass. The heating-resistor layer 4 includes an alloy, such as, Ta-SiO and made by a thin-film forming method, such as, sputtering. A conductive layer of aluminum, for example, is formed on the surface of the heating-resistor layer 4, and further, a common electrode 5 and separated electrodes 6 are formed thereon by photo-engraving. The common electrode 5 is formed like teeth of a comb on the one side of the glaze layer 3 from the center thereof. Several electrodes 6 are formed at the IC 8 side like strips aligned like teeth of a comb. The tips of the common electrode 5 and those of the separated electrodes 6 face each other at the summit of the semi-gabled glaze layer 3 with a predetermined gap. Connected to the other edge of each separated electrode 6 is a lead wire 9 extended from the IC 8. A heat- and abrasion-resistant protective-film layer 7 is formed by, for example, sputtering, over the surfaces of the common electrode 5 and the electrodes 6.

In this structure, a recording section 10 covers the summit of the protective-film layer 7 formed over the glaze layer 3 and the surrounding, as a thermal head having resolution of 220 to 400 d/i (the number of dots per inch).

The thermal head described above is provided with the recording section 10 at the portion corresponding to the summit of the glaze layer 3, thus having the common electrode 5 and the separated electrodes 6 with the tips of comb-like teeth facing each other over the center summit. The positions of the tips facing each other are sometimes shifted from the correct positions due to incomplete production process. This problem is discussed with respect to FIGS. 3 to 5.

The glaze layer 3 is usually formed with a semi-gabled transversal surface as illustrated in FIG. 3(*a*) by screen printing, for example. As shown in FIG. 3(*b*), the heating-resistor layer 4 and the conductive layer are stacked thereon. The photo-engraving is applied to the conductive layer to form the common electrode 5 and separated electrodes 6 with a gap 10A between the tips thereof. In the process of forming the glaze layer 3 on the ceramic substrate 2, as illustrated in FIG. 4, several glaze layers, for example, glaze layers 31 and 32 are simultaneously formed on a main surface of one ceramic substrate 2 followed by cutting on a dashed line Y to form a substrate (glazed ceramic substrate) having two glaze layers.

As described, since the conventional thermal head has a semi-gabled cross section, shifting of portions (recording section) at which electrodes facing each other if occur during patterning causes variation in height of the recording section from the substrate surface. Moreover, in formation of several glazed layers, wrinkles formed on a plate during screen printing could lower accuracy in straightness, thus causing undulation Z on a part of the glaze layer 2. Due to these problems, even photoengraving, a highly accurate electrode forming step, is applied to the conductive layer, as illustrated in FIG. 5, the recording section 10, which has to be located on the summit of the semi-gabled structure, is shifted from the summit, thus lowering printing quality.

DISCLOSURE OF THE INVENTION

A purpose of the present invention is, for solving the problems discussed above, to provide a thermal head and a method of producing the thermal head, by protecting a recording section from being shifted in height from a substrate, for attaining a higher printing quality and reliability and also a simplified production process.

Another purpose of the present invention is to provide a thermal head and a method of producing the thermal head, by protecting a recording section from being shifted which may otherwise occur due to shifting of a heating-resistor layer and separated electrodes caused by undulation of a glaze layer.

In order to attain the purposes, the thermal head according to the first aspect of the present invention includes a longitudinal substrate; a heat-retention layer made of a heat-retaining material, having at least a sticking-out section lying on one main surface of the substrate in a longitudinal direction at a constant width; a heating-resistor member made of a resistive material, formed at least on the sticking-out section of the heat-retention layer at a predetermined thickness; a common electrode provided as touching the heating-resistor member; a plurality of separated electrodes provided as facing a tip of the common electrode with a gap, at least an edge of each separated electrode touching the heating-resistor member, another edge of each separated electrode being connected to a driver circuit; and a protective layer formed on the heating-resistor member, a heating-resistor member portion provided on the gap between the common electrode and the separated electrodes functioning as a recording section, wherein the sticking-out section is formed in straight in the longitudinal direction of the substrate and has a almost flat summit surface, the recording section being formed on the flat summit surface.

In the thermal head according to the first aspect, the common electrode and the separated electrodes may be formed as rising from a side edge of the substrate in the longitudinal direction to a side face of the sticking-out section of the heat-retention layer and covering a side edge, in the longitudinal direction, of the heating-resistor member formed on the summit surface.

In the thermal head according to the first aspect, the heat-retention layer may have a skirt section formed on the main surface of the substrate at a almost constant thickness, the sticking-out section being formed on the skirt section as sticking out therefrom.

In the thermal head according to the first aspect, the heating-resistor member may be formed within a summit surface of the sticking-out section.

In the thermal head according to the first aspect, the separated electrodes and the common electrode may be formed as touching the heating-resistor member at a side face of the sticking-out section, summit surfaces of the separated electrodes and the common electrode and a summit surface of the heating-resistor member of the recording section forming an almost continuous plane.

Moreover, the method of producing a thermal head according to the second aspect of the present invention includes the steps of: a step of applying a heat-retaining material on a main surface of a substrate, thus forming a heat-retention layer; a step of applying a resistive material on a surface of the heat-retention layer, thus forming a heating-resistor layer; a step of forming a sticking-out section lying in straight, in a longitudinal direction, on the heating-resistor layer formed on an almost flat surface of the heat-retention layer by etching the heating-resistor layer and the heat-retention layer; a step of forming a common electrode, an edge thereof touching the heating-resistor member, and a plurality of separated electrodes provided as facing tips of the common electrode with a gap, at least one edge of each separated electrode touching the heating-resistor member; and a step of forming a protective layer at least on the heating-resistor member.

In the method of producing a thermal head according to the second aspect, it is preferable that the sticking-out section forming step has the step of forming the sticking-out section lying in straight, having a flat summit, including the heating-resistor member on the flat surface of the heat-retention layer by etching the heat-retention layer and the heating-resistor member stacked on the main surface of the substrate, and the electrode forming step has the step of forming the common electrode and the separated electrodes aligned like a row of teeth of a comb, the common electrode and the separated electrodes being provided from both sides of the sticking-out section to one main surface of the substrate, side faces of the heat-retention layer and a surface of the heating-resistor member, the teeth facing each other with a predetermined gap being connected to the heating-resistor member.

In the method of producing a thermal head according to the second aspect, it is preferable that the sticking-out section forming step has the step of forming the sticking-out section lying in straight, having a flat summit, over the main surface of the substrate, including the heating-resistor member on the almost flat surface of the heat-retention layer, the sticking-out section having a skirt section on both sides thereof in its cross sectional shape by etching the heat-retention layer and the heating-resistor member, and the electrode forming step has the step of forming the common electrode and the separated electrodes aligned like a row of teeth of a comb, the common electrode and the separated electrodes being provided from both sides of the sticking-out section to the skirt section of the sticking-out section, side faces thereof, and a surface of the heating-resistor member, the teeth facing each other with a predetermined gap being connected to the heating-resistor member.

The method of producing a thermal head according to the third aspect of the present invention includes the steps of: a step of applying a heat-retaining material on a main surface of the substrate, thus forming a heat-retention layer; a step of applying a resistive material on a surface of the heat-retention layer, thus forming a heating-resistor layer; a step of forming a sticking-out section lying in straight, in a longitudinal direction, on the heating-resistor layer formed at least on a flat summit surface of the heat-retention layer by etching the heat-retention layer; a step of forming a common electrode and a plurality of separated electrodes, edges of the electrodes being aligned like teeth of a comb and connected to the heating-resistor member, formed on the main surface of the substrate or the heat-retention layer in a direction from both sides of the sticking-out section to a side edge of the main surface of the substrate in a longitudinal direction, on the main surface of the substrate or another edge of each electrode being located in a side edge of the heat-retention layer in a longitudinal direction thereof, the common electrode and the separated electrodes being provided on at least a flat surface of the sticking-out section so that the common electrode and the separated electrodes face each other with a predetermined gap; and a step of forming a protective layer on the heating-resistor layer.

In the method of producing a thermal head according to the third aspect, it is preferable that the sticking-out section forming step has the step of forming the sticking-out section, lying in straight on the flat summit surface of the heat-retention layer, having an almost flat summit surface and a skirt section a cross section thereof being flat on both sides thereof, by etching the heat-retention layer, the heating-resistor member forming step has the step of applying the resistive material over the substrate from the skirt section of the heat-retention layer to the sticking-out section at an almost constant thickness, and the electrode forming step has the step of the forming the common electrode and the separated electrodes aligned like a row of teeth of a comb, the common electrode and the separated electrodes being provided from both sides of the sticking-out section to the skirt section and side faces of the sticking-out section, and a surface of the heating-resistor member, the teeth facing each other with a predetermined gap being connected to the heating-resistor member.

In the method of producing a thermal head according to the third aspect, it is preferable that the sticking-out section forming step has the step of forming the sticking-out section, lying in straight on the flat summit surface of the heat-retention layer, by etching the heat-retention layer, the heating-resistor member forming step has the step of applying the resistive material over the main surface of the substrate at an almost constant thickness except the entire sticking-out section of the heat-retention layer and a portion where the sticking-out section has been formed, and the electrode forming step has the step of the forming the common electrode and the separated electrodes aligned like a row of teeth of a comb, the common electrode and the separated electrodes being provided from both sides of the sticking-out section to the main surface of the substrate, side faces of the sticking-out section, and a surface of the heating-resistor member, the teeth facing each other with a predetermined gap being connected to the heating-resistor member.

The thermal head and the method of producing the thermal head according to each aspect provides the heat-retention layer of high straightness formed on the ceramic substrate with the sticking-out section of the glaze layer and also the recording section formed, between the tips of the common electrode and the separated electrodes, on the flat summit surface of the sticking-out section, thus achieving precise control of height of the recording section from the substrate for higher printing quality and reliability.

BEST MODE FOR CARRYING OUT THE INVENTION

Preferred embodiments according to the present invention will be disclosed with reference to the attached drawings.

Figure 1:
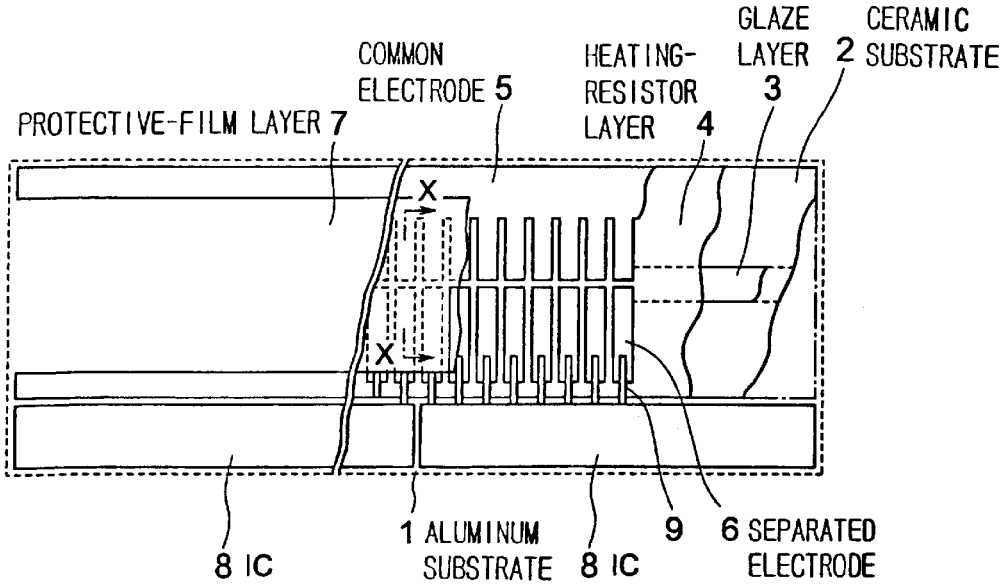
PRIOR ART FIG. 1
FIG. 1 shows a plan view of an overall structure of a conventional thermal head, partially cut away in several stages.
Figure 2:
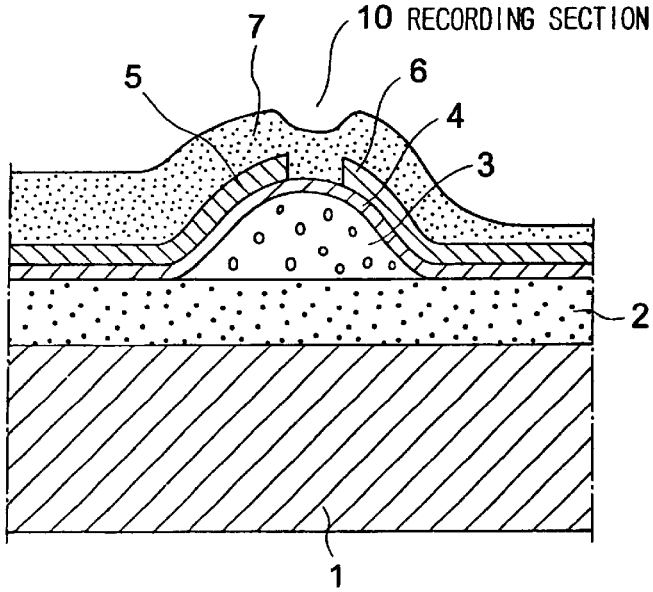
FIG. 2 PRIOR ART
FIG. 2 shows an enlarged cross sectional view of the conventional thermal head shown in FIG. 1.
Figure 3:
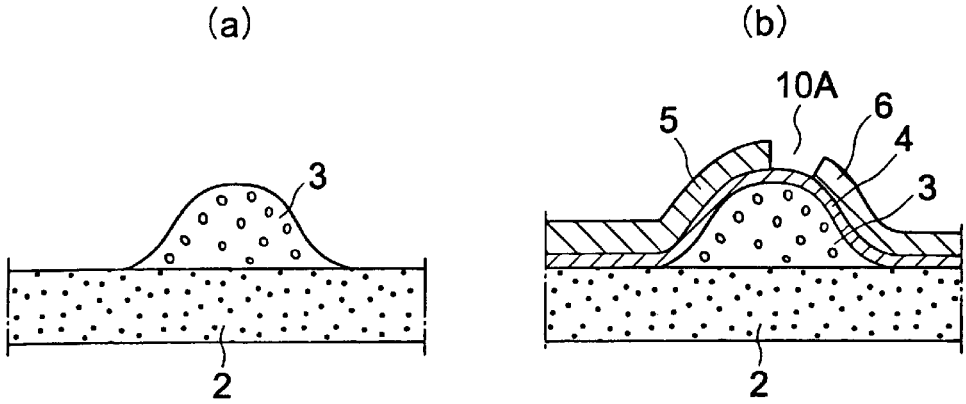
PRIOR ART FIG. 3
FIG. 3 shows cross sectional views (a) and (b) for explaining a production method of the conventional thermal head shown in FIG. 1.
Figure 4:
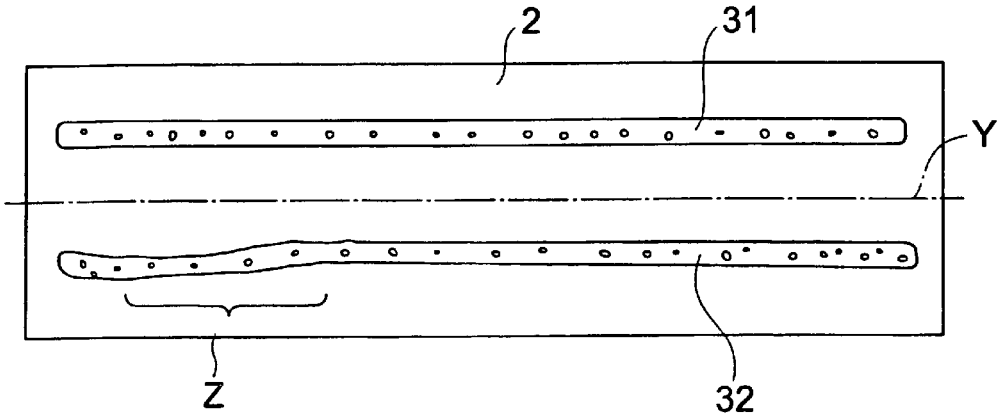
PRIOR ART FIG. 4
FIG. 4 is a plan view for explaining a production method of the conventional thermal head shown in FIG. 1.
Figure 5:
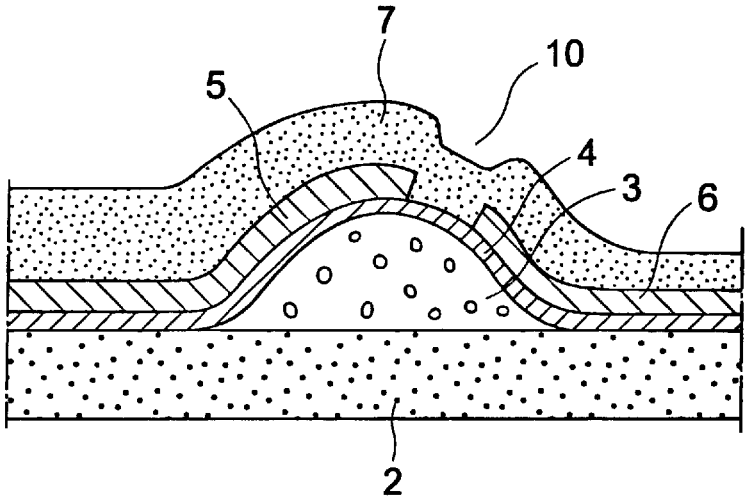
PRIOR ART FIG. 5
FIG. 5 is a cross sectional view of a structure of the conventional thermal head shown in FIG. 1, exhibiting a poor printing performance.
Figure 6:
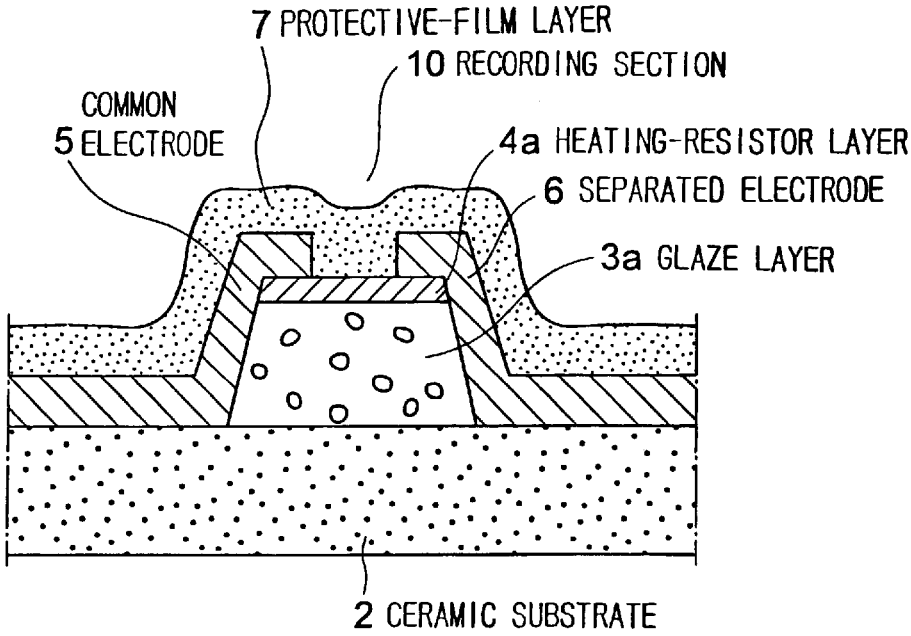
FIG. 6 is a cross sectional view of the first embodiment of a thermal head according to the present invention.

FIG. 6 is a cross sectional view of the first embodiment of a thermal head according to the present invention. Elements in this drawing referenced by the reference numbers the same as in FIGS. 1 to 5 are identical to the counterparts shown in FIGS. 1 to 5. The thermal head of the first embodiment shown in FIG. 6 is a type provided with a sticking-out glaze layer and a heating-resistor layer formed only on the flat summit of the sticking-out glaze layer.

The thermal head of the first embodiment is formed with a glaze layer 3*a* lying in straight in the longitudinal direction on a main surface of the ceramic substrate 2. The glaze layer 3*a* has a semi-gabled shape having a summit of almost flat cross section and almost constant width. Formed on the summit of the glaze layer 3*a* is a heating-resistor member 4*a* made of a resistive material at a certain thickness. The glaze layer 3*a* and the heating-resistor member 4*a* make up of a sticking-out section in the present invention. Also provided are the common electrode 5 and separated electrodes 6 which extend on both sides of the glaze layer 3*a* from a main surface of the ceramic substrate 2 to the side faces of the glaze layer 3*a* and further to the surface of the heating-resistor member 4*a*the tips of the electrodes 5 and 6 facing each other with a predetermined gap. A protective layer 7 is formed in a predetermined region covering the common electrode 5 and separated electrodes 6. The protective layer 7 is formed to cover all elements, particularly, as shown in FIG. 6, the tips of the common electrode 5 and separated electrodes 6 provided at both edges of the heating-resistor layer 4*a* formed on the summit of the sticking-out glaze layer 3*a*, and also the center portion of the summit corresponding to the gap. The center recording section 10 thus has a concave surface which is curved inwards in the middle a little bit.

Figure 7:
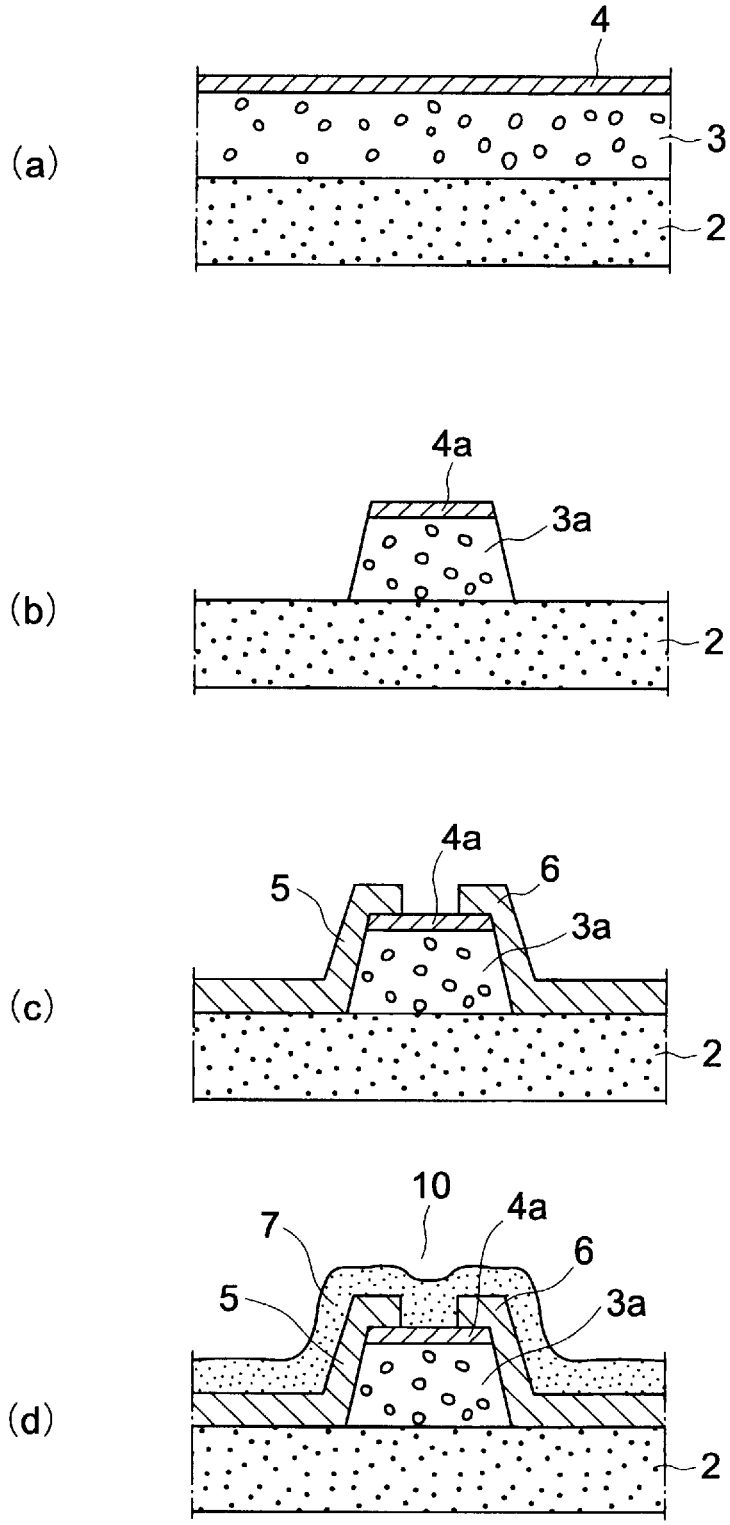
FIG. 7 shows cross sectional views (a) to (d) for explaining a production method of the first embodiment of the thermal head shown in FIG. 6.

Disclosed in detail, but focusing on the elements formed on the ceramic substrate 2, with reference to FIGS. 7(*a*) to 7(*d*), is a method of producing the thermal head in the first embodiment.

As illustrated in FIG. 7(*a*), the glaze layer 3 is formed on the entire main surface of the ceramic substrate 2, followed by a thin film formation step, such as, sputtering, to form the heating-resistor layer 4 made of Ta-SiO on the glaze layer 3 used as the support base. The glaze layer is formed by applying glass paste on the substrate with a squeegee followed by drying and burning steps.

Next, as illustrated in FIG. 7(*b*), a photoresist, etc., (not shown) is applied over the substrate 2 to have a straight portion of a predetermined width in the longitudinal direction through exposure and developing followed by etching using HF (hydrogen fluoride) as an etchant. These steps provide a sticking-out section in which the heating-resistor member 4*a* is formed, by like self-alignment, on the summit (of almost constant width) of the glaze layer-sticking-out section 3*a* having a semi-gabled cross section. The heating-resistor member 4*a* has a shape similar to the summit of the glaze layer-sticking-out section 3*a*.

An Al-film which will be formed as an electrode is formed on the substrate 2 by a thin-film forming method, such as, sputtering, followed by a photo-engraving process, thus forming, as illustrated in FIG. 7(*c*), the common electrode 5 and separated electrodes 6 which extend from one main surface of the ceramic substrate 2 on both side faces of the glaze layer-sticking-out section 3*a* to the side faces of the section 3*a* and further to the surface of the heating-resistor member 4*a*. The comb-like tips of the common electrode 5 and separated electrodes 6 face each other with a predetermined gap. The accuracy of straightness in the photo-engraving process is $\pm 10\mu$ to a 300 mm-long straight line. Thus, the present invention prevents undulation from occurring on the glaze layer-sticking-out section 3*a*, which is the problem for the conventional thermal head.

Next, as illustrated in FIG. 7(*d*), the protective layer 7 is formed using a sintered compact, a mixture of $Si_3$—$N_4$ and $SiO_2$, as a film forming base, to protect the tips of the common electrode 5 and separated electrodes 6 facing each other. Process requirements for etching is as follows: The first embodiment employs HF of 50% concentration as an etchant at an etching rate of about 1 μm/sec (1 μm-depth etching per second). As for the etchant and etching rate, it is preferable to employ $HF+H_2SO_4$ (sulfuric acid fluoride) of 50% concentration as an etchant at an etching rate of about 1 μm/sec, or HF of 50% concentration as an etchant at an etching rate of about 0.2 μm/sec.

The summit surface of the sticking-out section is substantially flat, maintaining flatness of the summit surface of the glaze layer before patterning. In other words, the surface roughness of the glaze layer after the sintering step is regarded as a substantially flat level.

The structure and the production method disclosed above provides the thermal head having the sticking-out pattern with high straightness and the recording section 10 accurately formed on the flat summit of the sticking-out section, thus enhancing printing quality and reliability, and also providing a simplified production process only with thin-film forming step which has generally been used.

Figure 8:
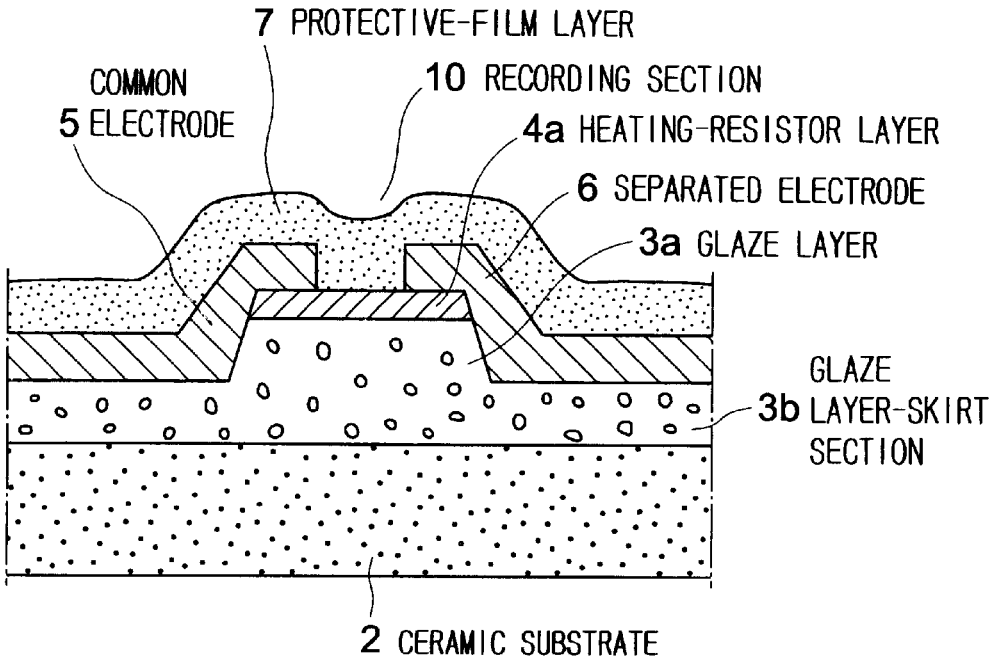
FIG. 8 is a cross sectional view of the second embodiment of a thermal head according to the present invention.

FIG. 8 is a cross sectional view of the second embodiment of a thermal head according to the present invention. Elements in the second embodiment that are the same as or analogous to elements in the first embodiment shown in FIG. 6 are referenced by the same reference numerals and will not be explained in detail. The thermal head of the second embodiment shown in FIG. 8 is a type provided with a glaze layer having a sticking-out section and a skirt section and a heating-resistor layer formed only on the flat summit of the sticking-out glaze layer.

The second embodiment is, like the first embodiment, formed with the glaze layer 3*a* lying in straight in the longitudinal direction on a main surface of the ceramic substrate 2. The glaze layer 3*a* has a semi-gabled shape having a summit almost flat cross section and almost constant width. The glaze layer-sticking-out section 3*a*, however, has a glaze layer-skirt section 3*b* on both sides thereof. Furthermore, the common electrode 5 and separated electrodes 6 are formed on the surface of the glaze layer skirt section 3*b*, the side face of the glaze layer-sticking-out section 3*a* and the surface of the heating-resistor member 4*a*. These are the differences in structure with respect to FIG. 6. Disclosed in detail, focusing on the elements formed on the ceramic substrate 2, with reference to FIGS. 9(*a*) to 9(*d*) is a method of producing the thermal head in the second embodiment.

Figure 9:
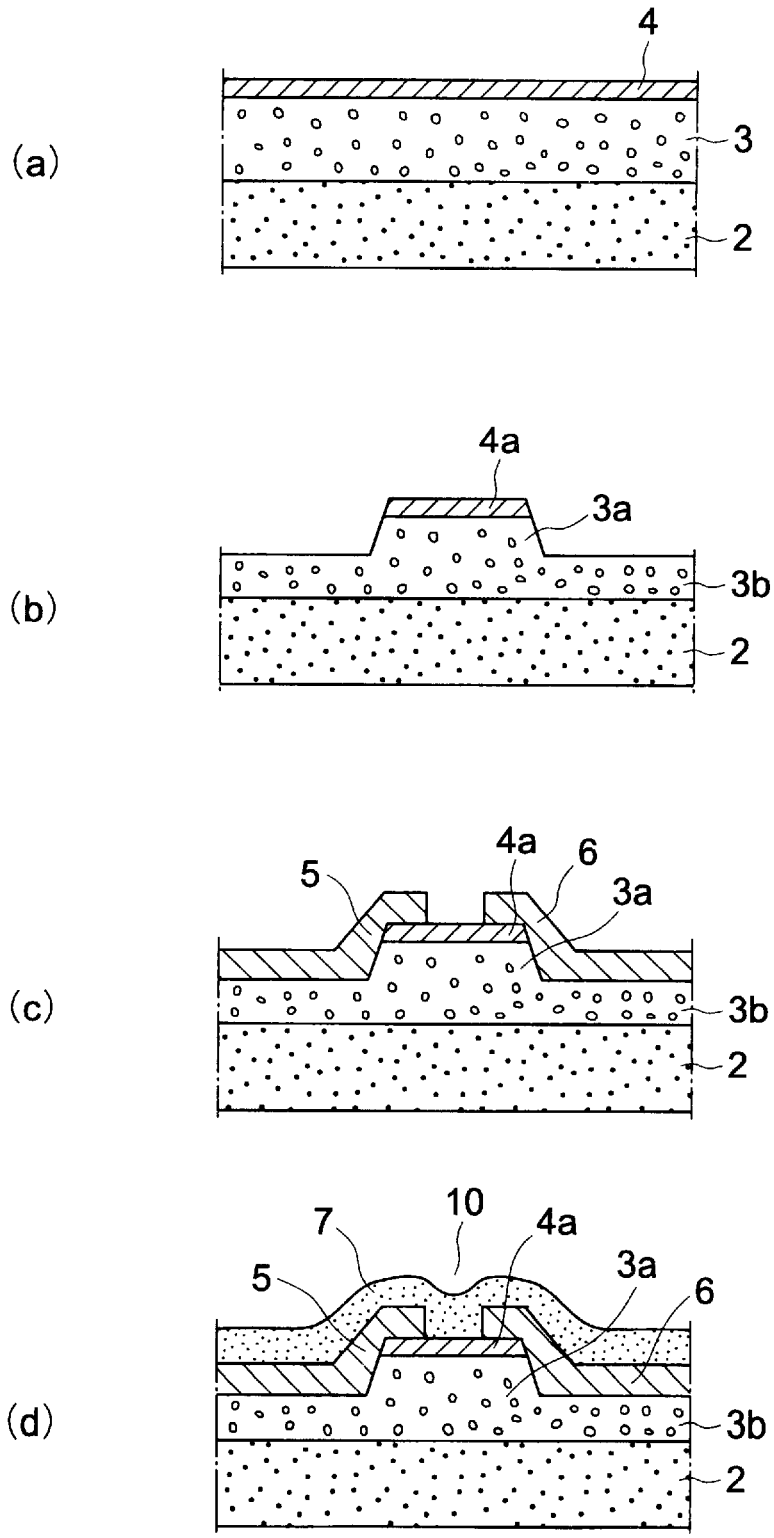
FIG. 9 shows cross sectional views (a) to (d) for explaining a production method of the second embodiment of the thermal head shown in FIG. 8.

As illustrated in FIG. 9(*a*), the glaze layer 3 is formed on the entire main surface of the ceramic substrate 2, followed by a thin film formation step, such as, sputtering, to form the heating-resistor layer 4 made of Ta-SiO on the glaze layer 3 used as the support base. Next, a photoresist, etc., (not shown) is applied over the substrate 2 for exposure and developing followed by etching using 90%-HF, as an as illustrated in FIG. 9(*b*), to have the glaze layer-sticking-out section 3*a* with a predetermined width in straight in the longitudinal direction of the ceramic substrate 2. The etching is halted to have the glaze layer-skirt section 3*b* with thickness about one-half of the glaze layer-sticking-out section 3*a*. The etching time is about one minute.

An Al-film which will be formed as an electrode is formed on the substrate 2 by a thin-film forming method, such as, sputtering, followed by a photo-engraving process, thus forming, as illustrated in FIG. 9(*c*), the common electrode 5 and separated electrodes 6 which extend from the glaze layer-skirt section 3*b* to the side faces of the glaze layer-sticking-out section 3*a* and further to the surface of the heating-resistor member 4*a*. The comb-like tips of the common electrode 5 and separated electrodes 6 face each other with a predetermined gap.

Next, as illustrated in FIG. 9(*d*), the protective layer 7 is formed using a sintered compact, a mixture of $Si_3$—$N_4$ and $SiO_2$, as a film forming base, to protect the tips of the common electrode 5 and separated electrodes 6 facing each other.

The structure and the production method disclosed above provides the thermal head having the heat-retention layer pattern with high straightness and the recording section 10 accurately formed on almost center of the summit of heat-retention layer in width direction, thus enhancing printing quality and reliability, and also providing a simplified production process. Moreover, the second embodiment achieves leveling of the surface of the ceramic substrate 2 with the glaze layer-skirt section 3*b*, thus enhancing contact of separated electrodes 5 and the common electrode 6. The glaze layer-skirt section 3*b* further serves to release heat from the electrodes.

The method of producing the thermal head in the first embodiment shown in FIG. 6 continues HF-etching until the both side faces of the glaze layer-sticking-out section 3*a* are etched out, which could lower contact of the section 3*a* to the ceramic substrate 2. In the second embodiment, however, contact to the ceramic substrate 2 is made by both the glaze layer-sticking-out section 3*a* and the glaze layer-skirt section 3*b* for firm contact.

Figure 10:
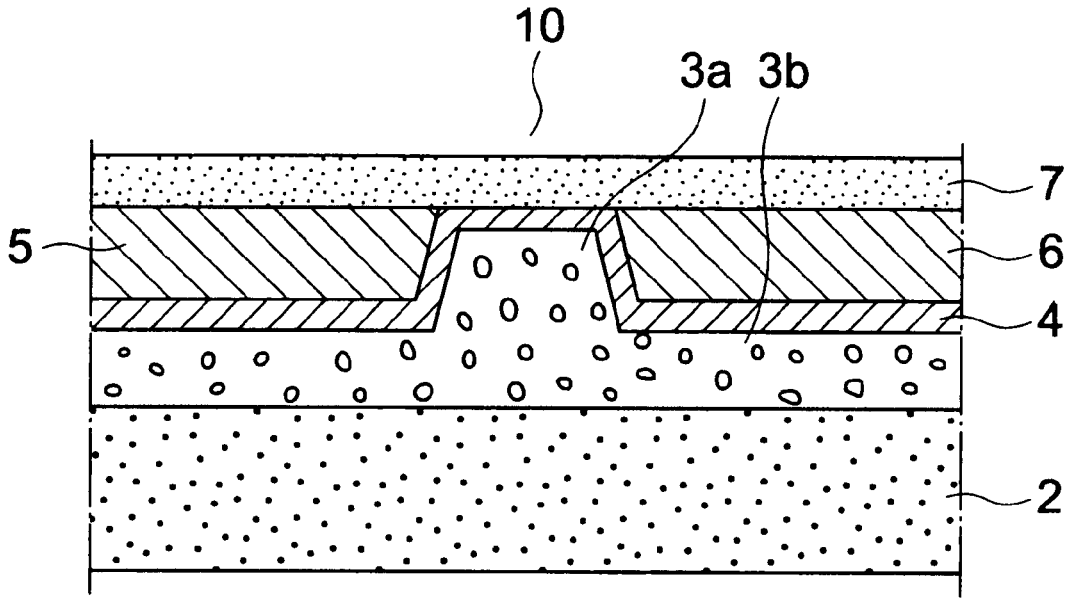
FIG. 10 is a cross sectional view of the third embodiment of a thermal head according to the present invention.
Figure 11:
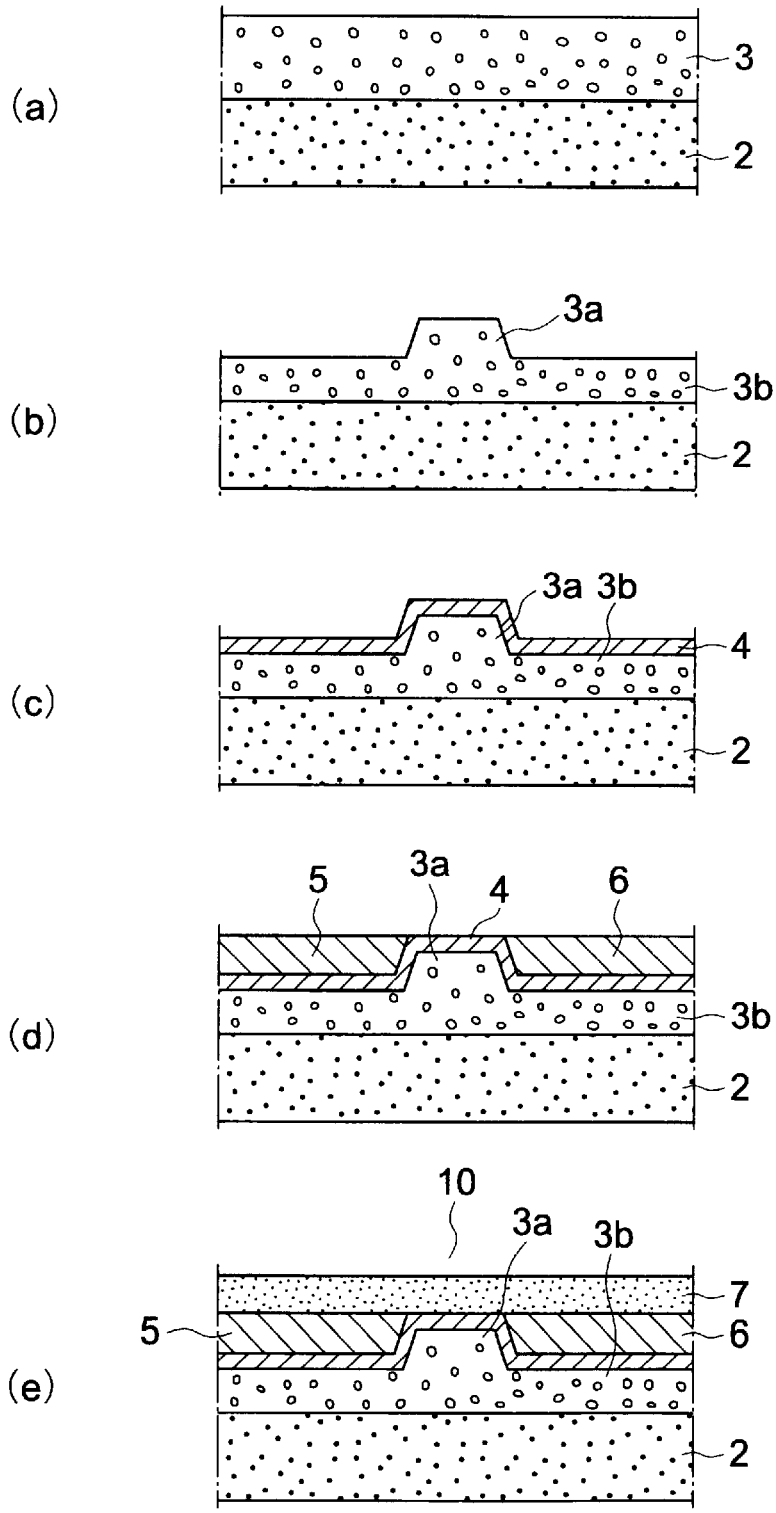
FIG. 11 shows cross sectional views (a) to (e) for explaining a production method of the third embodiment of the thermal head shown in FIG. 10.

Disclosed next with reference to FIGS. 10 and FIGS. 11(*a*) to 11(*e*) are a thermal head and a method of producing the thermal head in the third embodiment. Elements in the third embodiment that are the same as or analogous to elements in the first and the second embodiments are referenced by the same reference numerals. The thermal head shown in FIG. 10 in the third embodiment is a type provided with a glaze layer having a sticking-out section and a skirt section and a heating-resistor layer formed over the sticking-out section and the skirt section of the glaze layer.

The third embodiment is formed with a glaze layer having the skirt section 3*b* formed on a main surface of the ceramic substrate 2 at a almost constant thickness and a sticking-out section 3*a* as a heat-retention layer having an almost flat summit, lying in straight in the longitudinal detection of the substrate 2 and sticking out from the skirt section 3*b*. The heating-resistor member 4 is formed to cover the surface of the skirt section 3*b*, and both side faces of the summit of the sticking-out section 3*a* of the glaze layer 3. The common electrode 5 and separated electrodes 6 are formed on the skirt section 3*b* and the side faces of the sticking-out section 3*a* of the glaze layer 3, the tips of the common electrode 5 and separated electrodes 6 being electrically connected to the heating-resistor member 4 with a gap including the thickness of the member 4.

In this structure, the summits of separated electrodes and the common electrode and the summit of the heating-resistor layer on the sticking-out section form an almost continuous place. Disclosed next with reference to FIG. 11(*a*) to 11(*e*) is a method of producing the thermal head in the third embodiment shown in FIG. 10.

As illustrated in FIG. 11(*a*), the glaze layer 3 is formed on the entire main surface of the ceramic substrate 2, followed by applying a photoresist, etc., (not shown) over the substrate 2 for exposure and developing, and further by etching using 50%-HF, as illustrated in FIG. 11(*b*), to have the glaze layer-sticking-out section 3*a* with a predetermined width in straight in the longitudinal direction of the ceramic substrate 2. The etching is halted to have the glaze layer-skirt section 3*b* with thickness about one-half of the glaze layer-sticking-out section 3*a*. The etching time is about one minute.

Next, as illustrated in FIG. 11(*c*), the heating-resistor layer 4 made of Ta-SiO is formed by a thin-film forming method, such as, sputtering, using the glaze layer-sticking-out section 3*a* and the glaze layer-skirt section 3*b* as the support base.

An Al-film which will be formed as an electrode is formed by a thin-film forming method, such as, sputtering, followed by a photo-engraving process, thus forming, as illustrated in FIG. 11(*d*), the common electrode 5 and separated electrodes 6 on the surface of the heating-resistor member 4 on the side faces of the glaze layer-sticking-out section 3*a* and the surface of the glaze layer-skirt section 3*b*. The comb-like tips of the common electrode 5 and separated electrodes 6 face each other with a predetermined gap.

Next, as illustrated in FIG. 11(*e*), the protective layer 7 is formed using a sintered compact, a mixture of $Si_3$—$N_4$ and $SiO_2$, as a film forming base, to protect the tips of the common electrode 5 and separated electrodes 6 facing each other.

The structure and the production method disclosed above provides the thermal head having the pattern with high straightness and the recording section 10 accurately formed on the summit of the sticking-out section in width direction, thus enhancing printing quality and reliability, and also providing a simplified production process.

In the third embodiment, like the second embodiment, the glaze layer-skirt section 3*b* serves to enhance contact between separated electrodes 5 and the common electrode 6 and adjust the heat-retention characteristics with the heat-releasing function.

Disclosed next with reference to FIGS. 10 and FIGS. 11(*a*) to 11(*d*) are a thermal head and a method of producing the thermal head in the third embodiment. Elements in this embodiment that are the same as or analogous to elements in the foregoing embodiments are referenced by the same reference numerals. The thermal head shown in FIG. 12 in the fourth embodiment is a type provided with a glaze layer having a sticking-out section only and a heating-resistor layer formed over the substrate excluding the sticking-out section and the also over the sticking-out glaze layer.

Figure 12:
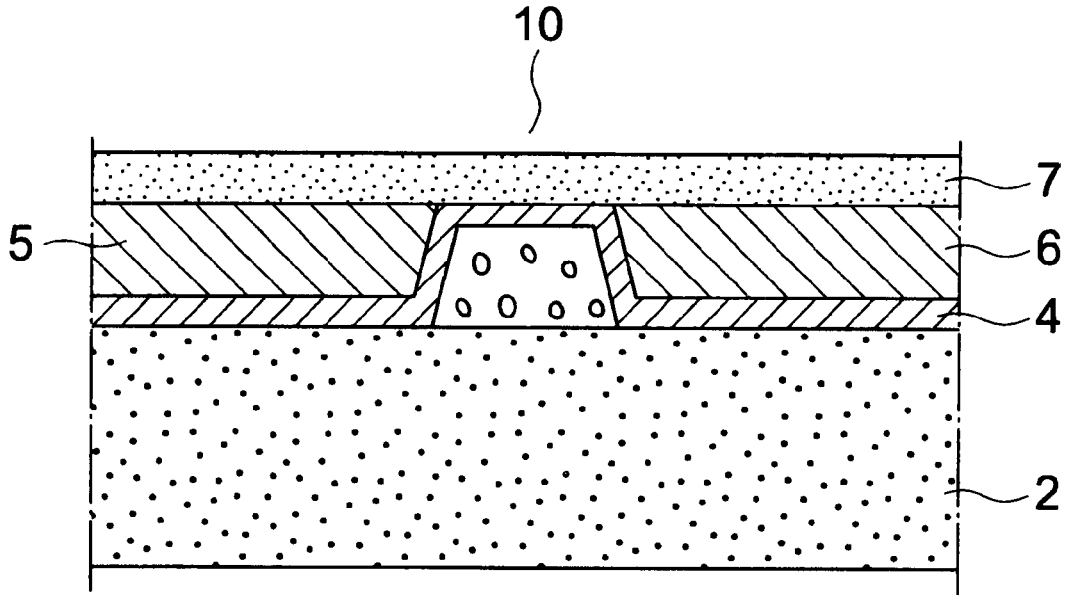
FIG. 12 is a cross sectional view of the fourth embodiment of a thermal head according to the present invention.

In FIG. 12, the fourth embodiment is formed with a glaze layer having the sticking-out section 3*a* only, as a heat-retention layer, having an almost flat summit. The heating-resistor member 4 is formed to cover the entire surface extending from a main surface of the substrate 2 to the side faces of the glaze layer-sticking-out section 3*a* and further to the flat summit. The common electrode 5 and separated electrodes 6 are formed on the surface of the heating-resistor member 4 excluding the surface the sticking-out section 3*a* and the side faces of the section 3*a*, the tips of the common electrode 5 and separated electrodes 6 being electrically connected to the heating-resistor member 4 with a gap including the width of the sticking-out section 3*a* and the thickness of the heating-resistor member 4 formed on the side faces of the sticking-out section 3*a*.

Figure 13:
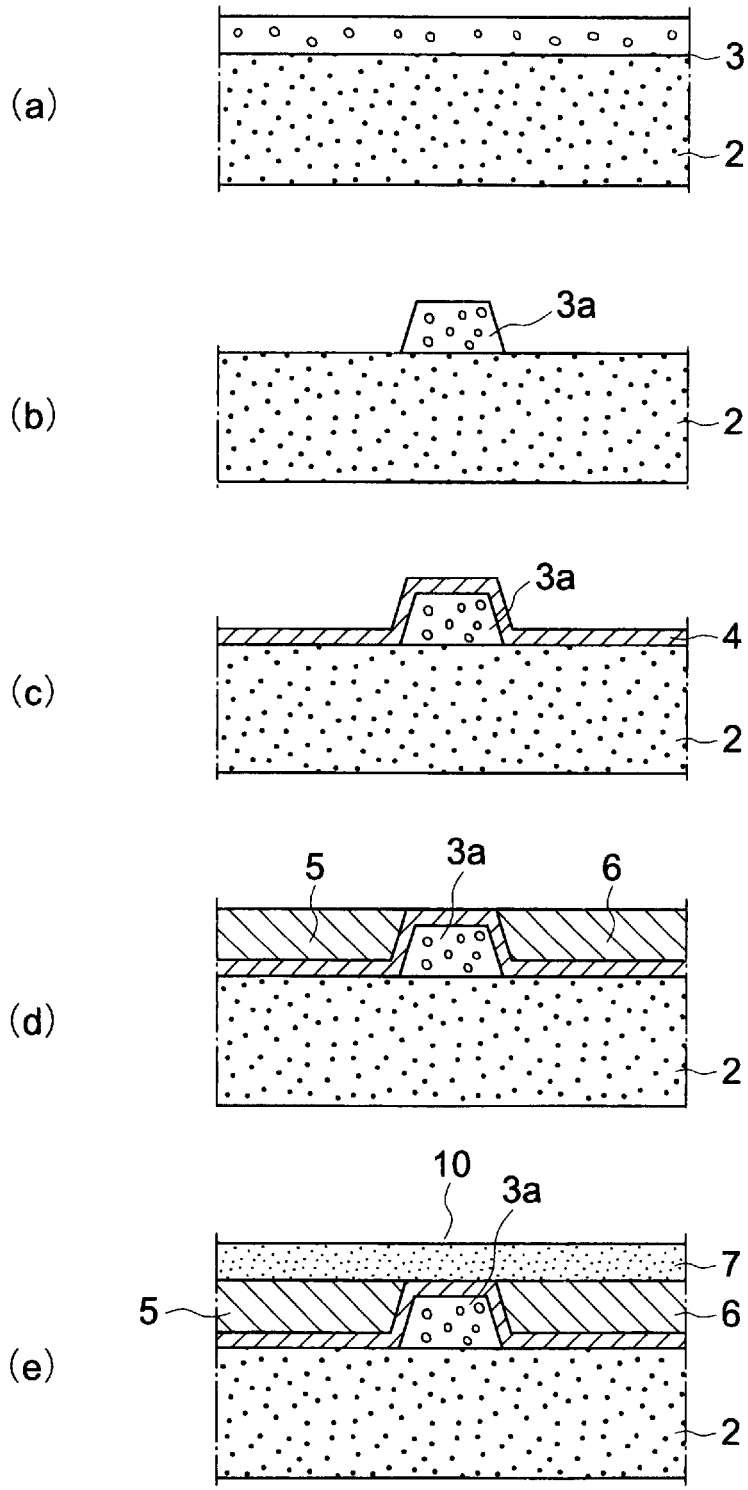
FIG. 13 shows cross sectional views (a) to (e) for explaining a production method of the fourth embodiment of the thermal head shown in FIG. 12.

Disclosed next with reference to FIG. 13(*a*) to 13(*e*) is a method of producing the thermal head in the fourth embodiment shown in FIG. 12.

As illustrated in FIG. 13(*a*), the glaze layer 3 is formed on the entire main surface of the ceramic substrate 2, followed by applying a photoresist, etc., (not shown) over the substrate 2 for exposure and developing, and further by etching using 50%-HF, as illustrated in FIG. 13(*b*), to have the glaze layer-sticking-out section 3*a* with a predetermined width in straight in the longitudinal direction of the ceramic substrate 2, The etching being halted in this state. The etching time is about one minute.

Next, as illustrated in FIG. 13(*c*), the heating-resistor layer 4 made of Ta-SiO is formed by a thin-film forming method, such as, sputtering, using the glaze layer-sticking-out section 3*a* and the substrate 2 as the support base.

An Al-film which will be formed as an electrode is formed by a thin-film forming method, such as, sputtering, followed by a photo-engraving process, thus forming, as illustrated in FIG. 13(*d*), the common electrode 5 and separated electrodes 6 on the surface of the heating-resistor member 4 on the substrate 2 where no glaze layer has been formed from the entire glaze layer-sticking-out section 3*a*. The comb-like tips of the common electrode 5 and separated electrodes 6 face each other with a predetermined gap.

Next, as illustrated in FIG. 13(*e*), the protective layer 7 is formed using a sintered compact, a mixture of $Si_3$—$N_4$ and $SiO_2$, as a film forming base, to protect the tips of the common electrode 5 and separated electrodes 6 facing each other. Production is then completed for the thermal head having the glaze layer of the sticking-out section 3*a* only.

The structure and the production method disclosed above provides the thermal head having the pattern with high accuracy and the recording section 10 formed on the flat summit of the heat-retention layer, thus enhancing printing quality and reliability, and also providing a simplified production process.

As disclosed above, the present invention achieves enhanced printing quality with protection of the recording section from being shifted in height from the substrate surface, and also achieves high reliability and simplicity in production process.

What is claimed is:

1. A thermal head comprising:

a longitudinal substrate;

a heat-retention layer made of a heat-retaining material, having at least a sticking-out section lying on one main surface of the substrate in a longitudinal direction at a constant width;

a heating-resistor member made of a resistive material, formed at least on the sticking-out section of the heat-retention layer at a predetermined thickness and having a predetermined width same as said constant width of said sticking-out section;

a common electrode provided touching the heating-resistor member;

a plurality of separated electrodes provided facing a tip of the common electrode with a gap, at least an edge of each separated electrode touching the heating-resistor member, another edge of each separated electrode being connected to a driver circuit; and a protective layer formed on the heating-resistor member, a heating-resistor member portion provided on the gap between the common electrode and the separated electrodes functioning as a recording section, wherein the sticking-out section is formed straight in a longitudinal direction of the substrate and has an almost flat summit surface, the recording section being formed on the almost flat summit surface.

2. The thermal head according to claim 1, wherein the common electrode and the separated electrodes are formed rising from a side edge of the substrate in the longitudinal direction to a side face of the sticking-out section of the heat-retention layer and covering a side edge, in the longitudinal direction, of the heating-resistor member formed on the summit surface.

3. The thermal head according to claim 1, wherein the heat-retention layer includes a skirt section formed on the main surface of the substrate at an almost constant thickness, the sticking-out section being formed on the skirt section, sticking out therefrom.

4. The thermal head according to claim 1, wherein the separated electrodes and the common electrode are formed touching the heating-resistor member at a side face of the sticking-out section, summit surfaces of the separated electrodes and the common electrode and a summit surface of the heating-resistor member of the recording section forming an almost continuous plane.

5. A method of producing a thermal head comprising the steps of:

a step of applying a heat-retaining material on a main surface of a substrate, thus forming a heat-retention layer;

a step of applying a resistive material on a surface of the heat-retention layer, thus forming a heating-resistor layer;

a step of forming a sticking-out section lying straight, in a longitudinal direction, on the heating-resistor layer formed on an almost flat surface of the heat-retention layer by etching the heating-resistor layer and the heat-retention layer, said sticking-out section having a predetermined width same as a constant width of the heating-resistor layer;

a step of forming a common electrode, an edge thereof touching the heating-resistor member, and a plurality of separated electrodes provided facing tips of the common electrode with a gap, at least one edge of each separated electrode touching the heating-resistor member, both of the edges of said common and separated electrodes being located on said almost flat surface of the heating-resistor member; and a step of forming a protective layer at least on the heating-resistor member.

6. The method of producing a thermal head according to claim 5, wherein the sticking-out section forming step includes the step of forming the sticking-out section lying straight, having a flat summit, including the heating-resistor member on the flat surface of the heat-retention layer by etching the heat-retention layer and the heating-resistor member stacked on the main surface of the substrate, and the electrode forming step includes the step of forming the common electrode and the separated electrodes aligned as opposing combs, the common electrode and the separated electrodes being provided from both sides of the sticking-out section to one main surface of the substrate, side faces of the heat-retention layer and a surface of the heating-resistor member, the teeth facing each other with a predetermined gap being connected to the heating-resistor member.

7. The method of producing a thermal head according to claim 5, wherein the sticking-out section forming step includes the step of forming the sticking-out section lying straight, having a flat summit, over the main surface of the substrate, including the heating-resistor member on the almost flat surface of the heat-retention layer, the sticking-out section having a skirt section on both sides thereof in its cross sectional shape by etching the heat-retention layer and the heating-resistor member, and the electrode forming step includes the step of forming the common electrode and the separated electrodes as opposing combs, the common electrode and the separated electrodes being provided from both sides of the sticking-out section to the skirt section of the sticking-out section, side faces thereof, and a surface of the heating-resistor member, the teeth facing each other with a predetermined gap being connected to the heating-resistor member.

8. A method of producing a thermal head comprising the steps of:

a step of applying a heat-retaining material on a main surface of the substrate, thus forming a heat-retention layer;

a step of applying a resistive material on a surface of the heat-retention layer, thus forming a heating-resistor layer having a first flat-summit surface;

a step of forming a sticking-out section lying straight, in a longitudinal direction, by etching the heat-retention layer;

a step of forming a common electrode and a plurality of separated electrodes each having second flat-summit surfaces, edges of the electrodes being aligned as opposing combs and connected to the heating-resistor member, formed on the main surface of the substrate or the heat-retention layer in a direction from both sides of the sticking-out section to a side edge of the main surface of the substrate in a longitudinal direction, another edge of each electrode being located on the main surface of the substrate or in a side edge of the heat-retention layer in a longitudinal direction thereof, the common electrode and the separated electrodes being provided on at least a flat surface of the sticking-out section so that the common electrode and the separated electrodes face each other with a predetermined gap, and that said first flat-summit surface of said heating-resistor layer substantially continues to said second flat-summit surfaces of said common electrode and said plurality of separated electrodes; and a step of forming a protective layer on the heating-resistor layer.

9. The method of producing a thermal head according to claim 8, wherein the sticking-out section forming step includes the step of forming the sticking-out section, lying straight on the flat summit surface of the heat-retention layer, having an almost flat summit surface and a skirt section a cross section thereof being flat on both sides thereof, by etching the heat-retention layer, the heating-resistor member forming step includes the step of applying the resistive material over the substrate from the skirt section of the heat-retention layer to the sticking-out section at an almost constant thickness, and the electrode forming step includes the step of the forming the common electrode and the separated electrodes as opposing combs, the common electrode and the separated electrodes being provided from both sides of the sticking-out section to the skirt section and side faces of the sticking-out section, and a surface of the heating-resistor member, the teeth facing each other with a predetermined gap being connected to the heating-resistor member.

10. The method of producing a thermal head according to claim 9, wherein the sticking-out section forming step includes the step of forming the sticking-out section, lying straight on the flat summit surface of the heat-retention layer, by etching the heat-retention layer, the heating-resistor member forming step includes the step of applying the resistive material over the main surface of the substrate at an almost constant thickness except the entire sticking-out section of the heat-retention layer and a portion where the sticking-out section has been formed, and the electrode forming step includes the step of the forming the common electrode and the separated electrodes aligned as opposing combs, the common electrode and the separated electrodes being provided from both sides of the sticking-out section to the main surface of the substrate, side faces of the sticking-out section, and a surface of the heating-resistor member, the teeth facing each other with a predetermined gap being connected to the heating-resistor member.

* * * * *